US010184487B2

(12) United States Patent
Hayamitsu et al.

(10) Patent No.: US 10,184,487 B2
(45) Date of Patent: Jan. 22, 2019

(54) BLOWER APPARATUS AND VACUUM CLEANER

(71) Applicant: Nidec Corporation, Kyoto (JP)

(72) Inventors: Ryosuke Hayamitsu, Kyoto (JP); Jumpei Kitamura, Kyoto (JP)

(73) Assignee: Nidec Corporation, Kyoto (JP)

( * ) Notice: Subject to any disclaimer, the term of this patent is extended or adjusted under 35 U.S.C. 154(b) by 98 days.

(21) Appl. No.: 15/522,953

(22) PCT Filed: Oct. 30, 2015

(86) PCT No.: PCT/JP2015/080696
§ 371 (c)(1),
(2) Date: Apr. 28, 2017

(87) PCT Pub. No.: WO2016/068282
PCT Pub. Date: May 6, 2016

(65) Prior Publication Data

US 2017/0311766 A1 Nov. 2, 2017

Related U.S. Application Data

(60) Provisional application No. 62/168,135, filed on May 29, 2015.

(30) Foreign Application Priority Data

Oct. 30, 2014 (JP) ..... 2014-220914

(51) Int. Cl.
*A47L 5/28* (2006.01)
*F04D 25/06* (2006.01)
(Continued)

(52) U.S. Cl.
CPC ..... *F04D 29/444* (2013.01); *A47L 5/28* (2013.01); *F04D 17/16* (2013.01); *F04D 25/06* (2013.01); *F04D 29/281* (2013.01); *F04D 29/441* (2013.01)

(58) Field of Classification Search
CPC ..... F04D 29/444; F04D 17/16; F04D 25/06; F04D 29/281; F04D 29/441; A47L 5/28
See application file for complete search history.

(56) References Cited

U.S. PATENT DOCUMENTS 9,564,787 B2 * 2/2017 Kitamura ..... H02K 9/06
2017/0314573 A1 * 11/2017 Hayamitsu ..... A47L 5/28
(Continued)

FOREIGN PATENT DOCUMENTS

GB 1160136 A 8/1966
JP 10-141290 A 5/1998
(Continued)

OTHER PUBLICATIONS

Hayamitsu, R. et al.; "Blower Apparatus and Vacuum Cleaner"; U.S. Appl. No. 15/522,974, filed Apr. 28, 2017.
(Continued)

*Primary Examiner* — Dung Van Nguyen
(74) *Attorney, Agent, or Firm* — Keating & Bennett, LLP

(57) ABSTRACT

A blower apparatus includes a motor portion having a central axis extending in a vertical direction; an impeller arranged above the motor portion, joined to a rotating portion of the motor portion, and arranged to rotate to send a gas from above radially outward; an impeller cover portion including an inner surface arranged to cover an outer circumference of the impeller and an upper side of an outer edge portion of the impeller, and further including an air inlet defined in a center thereof; and a body cover portion joined to the impeller cover portion, arranged to cover an
(Continued)

outer circumferential surface of the motor portion, and arranged to define a tubular space between the motor portion and the body cover portion. The tubular space includes an upper region and a lower region arranged below the upper region. A radial distance between the outer circumferential surface of the motor portion and an inner circumferential surface of the body cover portion is arranged to continuously decrease with decreasing height in the upper region, and continuously increase with decreasing height in the lower region. The radial distance is arranged to be greater at an upper end of the upper region than at a lower end of the lower region.

11 Claims, 10 Drawing Sheets

(51) Int. Cl.

| | |
|---|---|
| ***F04D 29/28*** | (2006.01) |
| ***F04D 29/44*** | (2006.01) |
| ***F04D 17/16*** | (2006.01) |

(56) References Cited

U.S. PATENT DOCUMENTS

| | | | | |
|---|---|---|---|---|
| 2017/0367550 | A1* | 12/2017 | Shiozawa | F04D 29/44 |
| 2018/0100517 | A1* | 4/2018 | Sawada | A47L 9/00 |
| 2018/0140145 | A1* | 5/2018 | Hayamitsu | F04D 29/44 |
| 2018/0156233 | A1* | 6/2018 | Sawada | F04D 29/44 |
| 2018/0160872 | A1* | 6/2018 | Hayamitsu | F04D 29/58 |
| 2018/0163747 | A1* | 6/2018 | Hayamitsu | F04D 29/44 |

FOREIGN PATENT DOCUMENTS

| | | | |
|---|---|---|---|
| JP | 11-125198 | A | 5/1999 |
| JP | 11-336696 | A | 12/1999 |
| JP | 2010-209770 | A | 9/2010 |
| JP | 2010-281232 | A | 12/2010 |
| JP | 2011-080427 | A | 4/2011 |

OTHER PUBLICATIONS

Shiozawa, K. et al.; "Blower Apparatus and Vacuum Cleaner"; U.S. Appl. No. 15/527,049, filed May 16, 2017.
Sawada, T. et al.; "Centrifugal Blower and Vacuum Cleaner"; U.S. Appl. No. 15/567,087, filed Oct. 17, 2017.
Hayamitsu, R. et al.; "Blower Device and Vacuum Cleaner"; U.S. Appl. No. 15/577,425, filed Nov. 28, 2017.
Hayamitsu, R. et al.; "Blower and Vacuum Cleaner"; U.S. Appl. No. 15/577,421, filed Nov. 28, 2017.
Hayamitsu, R. et al.; "Blower and Vacuum Cleaner"; U.S. Appl. No. 15/576,338, filed Nov. 22, 2017.
Hayamitsu, R. et al.; "Blower and Vacuum Cleaner"; U.S. Appl. No. 15/577,431, filed Nov. 28, 2017.
Sawada, T. et al., "Blower and Vacuum Cleaner"; U.S. Appl. No. 15/576,311, filed Nov. 22, 2017.

* cited by examiner

BLOWER APPARATUS AND VACUUM CLEANER

BACKGROUND OF THE INVENTION

1. Field of the Invention

The present invention relates to an electric blower apparatus and a vacuum cleaner. The blower apparatus is installed in, for example, a vacuum cleaner.

2. Description of the Related Art

Blower apparatuses installed in vacuum cleaners are required to have a high static pressure. Such blower apparatuses are disclosed in, for example, JP-A 2010-281232 and JP-A 2011-80427. In each of these blower apparatuses, plate-shaped air guides are provided to guide a flow of air downward from a lateral side of an impeller. The air is sucked in through a center of the impeller, and is sent radially outward from the impeller. The air is then guided to a space radially outside of a motor arranged below through the air guides.

Each of the plate-shaped air guides, which are arranged to downwardly guide air sent radially outward from the impeller, includes a curved portion which is inclined to guide the flow of air, but when the impeller rotates at a high speed, a separation of the air may occur at a surface of any air guide to cause noise. A reduction in noise is particularly important when the blower apparatus is used in a consumer product, such as, for example, a vacuum cleaner.

SUMMARY OF THE INVENTION

A blower apparatus according to a preferred embodiment of the present invention includes a motor portion having a central axis extending in a vertical direction; an impeller arranged above the motor portion, joined to a rotating portion of the motor portion, and arranged to rotate to send a gas from above radially outward; an impeller cover portion including an inner surface arranged to cover an outer circumference of the impeller and an upper side of an outer edge portion of the impeller, and further including an air inlet defined in a center thereof; and a body cover portion joined to the impeller cover portion, arranged to cover an outer circumferential surface of the motor portion, and arranged to define a tubular space between the motor portion and the body cover portion. The tubular space includes an upper region and a lower region arranged below the upper region. A radial distance between the outer circumferential surface of the motor portion and an inner circumferential surface of the body cover portion is arranged to continuously decrease with decreasing height in the upper region, and continuously increase with decreasing height in the lower region. The radial distance is arranged to be greater at an upper end of the upper region than at a lower end of the lower region.

The above preferred embodiment of the present invention is able to reduce noise of the blower apparatus while maintaining a static pressure in the blower apparatus. In addition, a vacuum cleaner including the above-described blower apparatus is able to achieve reduced noise while maintaining a static pressure therein.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Hereinafter, a blower apparatus according to a preferred embodiment of the present invention will be described with reference to the accompanying drawings. It is assumed herein that a direction parallel or substantially parallel to a central axis of a blower apparatus is referred to by the term "axial direction", "axial", or "axially", that directions perpendicular or substantially perpendicular to the central axis of the blower apparatus are each referred to by the term "radial direction", "radial", or "radially", and that a direction along a circular arc centered on the central axis of the blower apparatus is referred to by the term "circumferential direction", "circumferential", or "circumferentially". It is also assumed herein that an axial direction is a vertical direction, and that a side on which an impeller is arranged with respect to a motor is defined as an upper side. The shape of each member or portion and relative positions of different members or portions will be described based on the above assumptions. It should be noted, however, that the above definitions of the vertical direction and the upper side are not meant to restrict in any way the orientation of a blower apparatus according to any preferred embodiment of the present invention when in use.

Figure 1:
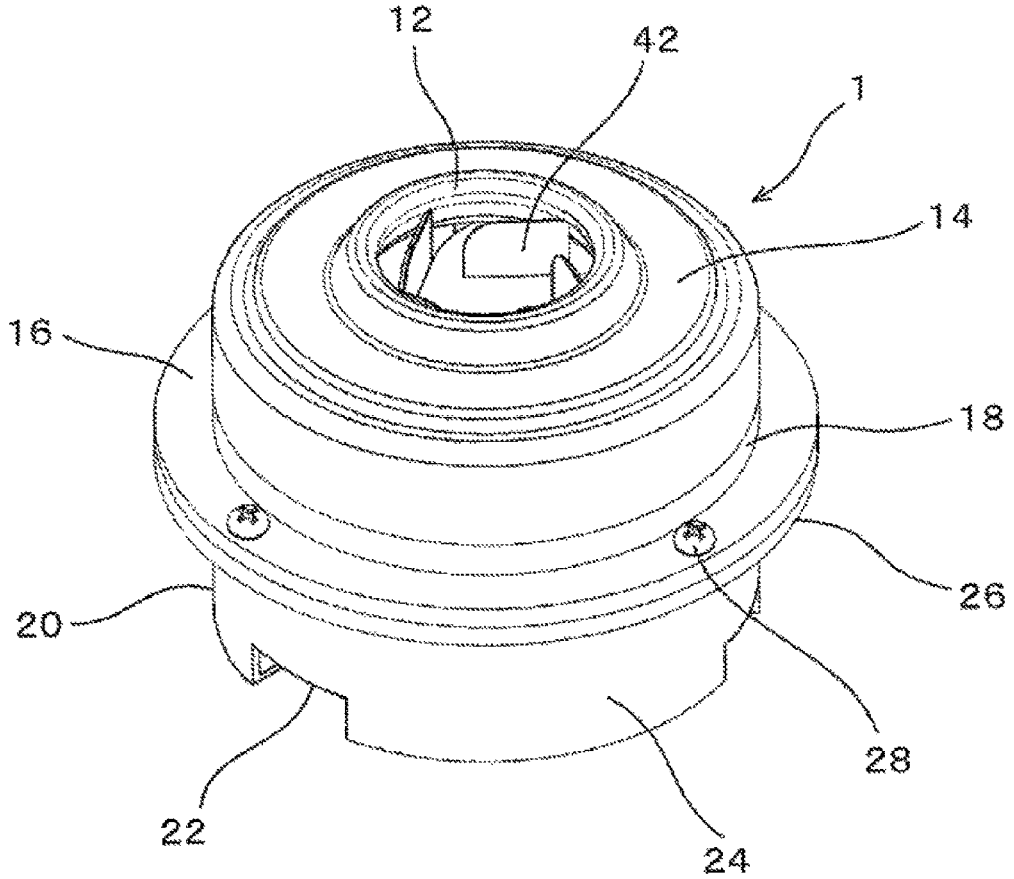
FIG. 1 is a perspective view of a blower apparatus according to a preferred embodiment of the present invention.

FIG. 1 is a perspective view illustrating the overall structure of a blower apparatus 1 according to a preferred embodiment of the present invention. The blower apparatus 1 includes an impeller cover portion 14 and a body cover portion 2 arranged in an outer portion thereof. The impeller cover portion 14 is a member in the shape of a cap, made of a metal, and including an air inlet 12 defined in a central portion of an upper surface thereof. The body cover portion 2 includes an upper cover 18 and a lower cover 20. The upper cover 18 is a resin-molded article including a cylindrical portion to which a cylindrical portion of the impeller cover portion 14 is fitted from radially outside, and an upper flange portion 16 defined integrally with a lower end of the cylindrical portion of the upper cover 18. The lower cover 20 is a resin-molded article including a lower cylindrical portion 24, which includes a plurality of air outlets 22 defined in a lower portion of an outer circumference thereof, and a lower flange portion 26 defined integrally with an upper end of the lower cylindrical portion 24. The upper and lower flange portions 16 and 26, which are arranged above and below, respectively, are joined to each other and are fastened through screws 28. The upper and lower covers 18 and 20 are thus joined to each other. More specifically, screw insert holes are defined at several circumferential positions in the upper flange portion 16, while screw holes are defined at several circumferential positions in the lower flange portion 26 such that the screw holes are opposed to the screw insert holes. The screws 28 are screwed into the screw holes through the screw insert holes.

Figure 2:
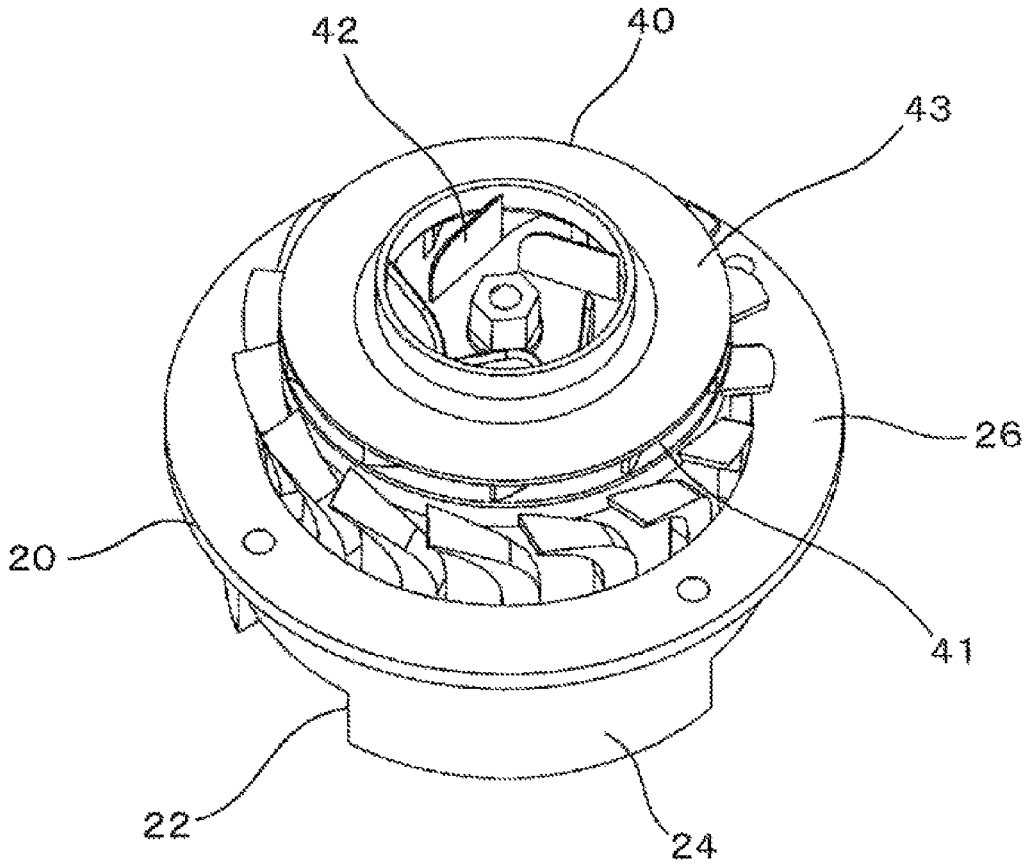
FIG. 2 is a perspective view of the blower apparatus illustrated in FIG. 1 with an impeller cover portion removed therefrom.
Figure 3:
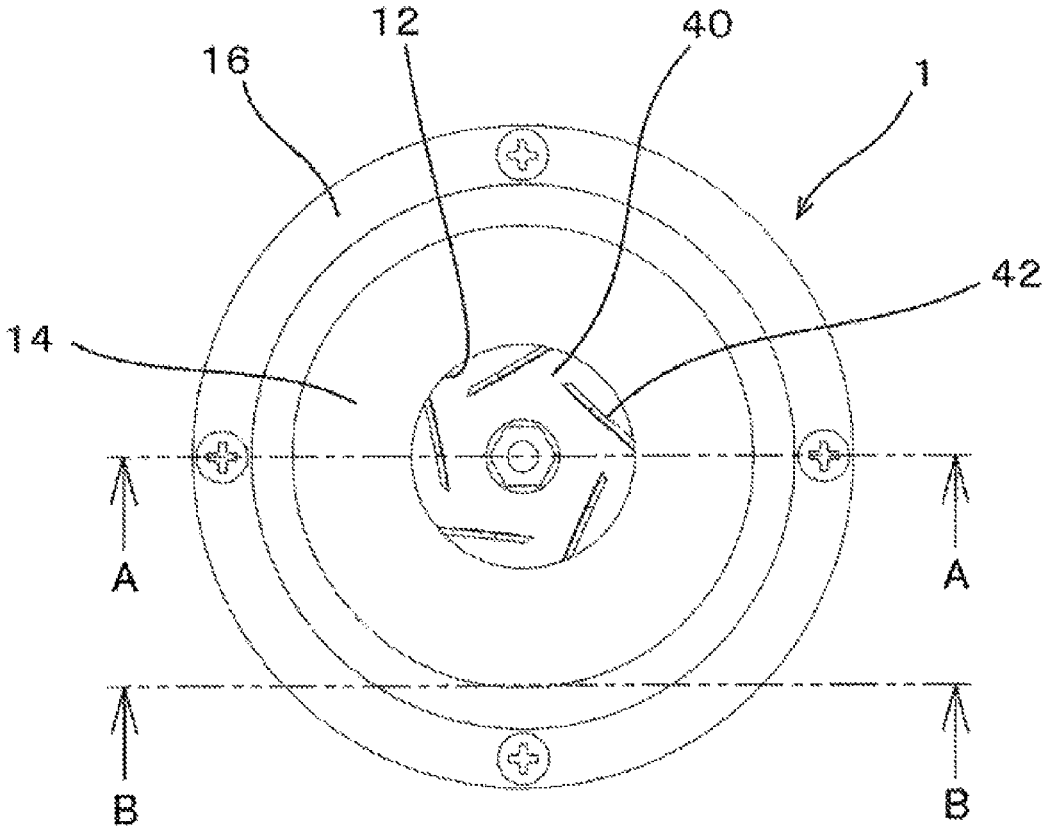
FIG. 3 is a plan view of the blower apparatus illustrated in FIG. 1.
Figure 4:
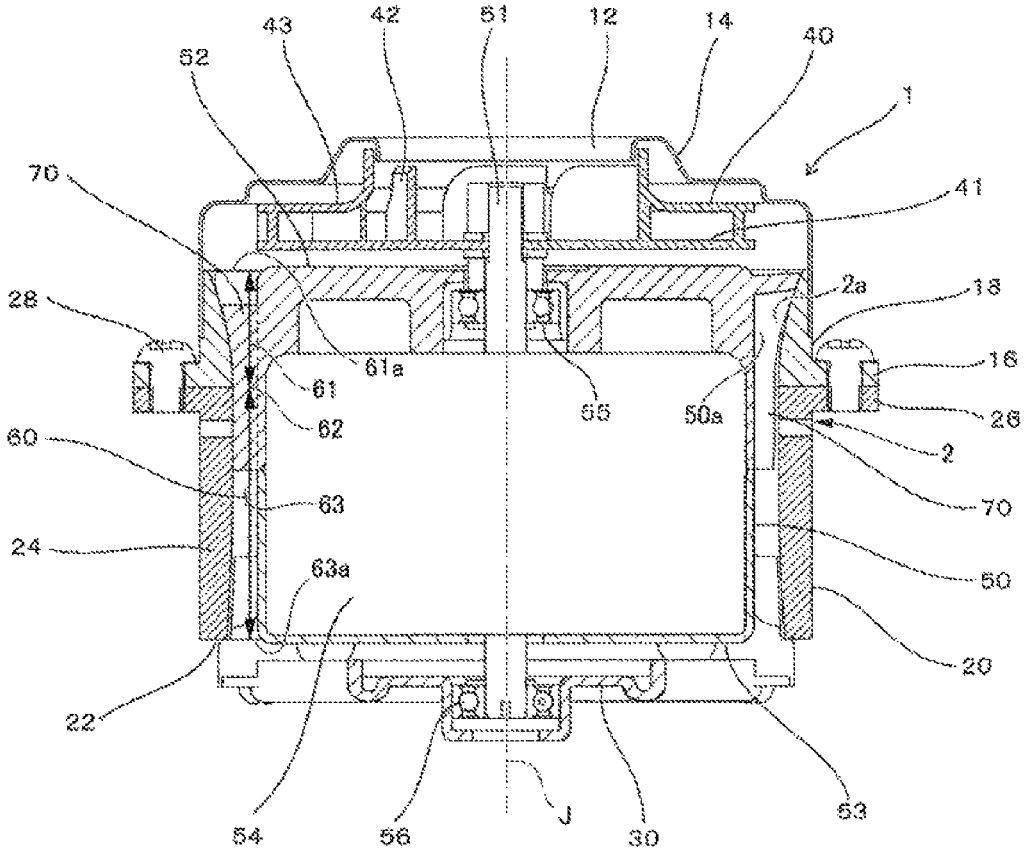
FIG. 4 is a cross-sectional view of the blower apparatus taken along line A-A in FIG. 3.

FIG. 2 is a perspective view of the blower apparatus 1 illustrated in FIG. 1 with the impeller cover portion 14 removed therefrom. FIG. 3 is a plan view of the blower apparatus 1. FIG. 4 is a vertical cross-sectional view of the blower apparatus 1 taken along line A-A, which passes through a center of the blower apparatus 1, in FIG. 3. Parallel oblique lines for details of sections of the blower apparatus 1 may be omitted.

Referring to FIG. 4, an interior space of the blower apparatus 1 is defined by the impeller cover portion 14, the upper cover 18, the lower cover 20, and a bottom cover 30, which is attached to the lower cover 20 to cover a lower surface of the lower cover 20. The blower apparatus 1 further includes an impeller 40, which is defined by a centrifugal impeller, and a motor portion 50, which has a central axis J extending in the vertical direction, in the interior space.

The impeller 40 is covered with the impeller cover portion 14. The impeller cover portion 14 includes a cylindrical outer circumferential portion arranged to cover an outer circumference of the impeller 40, and an upper surface portion arranged to cover an upper side of an outer edge portion of the impeller 40. That is, the impeller cover portion 14 includes an inner surface arranged to cover the outer circumference of the impeller 40 and the upper side of the outer edge portion of the impeller 40. In addition, the impeller cover portion 14 includes the air inlet 12 defined in the central portion of the upper surface thereof. The impeller 40 includes a base plate 41, which is defined by a flat circular board, a plurality of rotor blades 42 arranged in a circumferential direction on an upper surface of the base plate 41, and a shroud 43 in the shape of a curved conical surface, including a central opening, and arranged to join upper ends of the rotor blades 42 to one another. An upper end portion of a rotating shaft 51 of the motor portion 50 is joined to a central portion of the base plate 41. The impeller 40 is thus attached to a rotating portion of the motor portion 50. The central opening of the shroud 43 of the impeller 40 is arranged to be in communication with the air inlet 12 of the impeller cover portion 14.

The motor portion 50 is, for example, an inner-rotor brushless motor, and includes a motor housing, which includes an upper housing portion 52 and a lower housing portion 53, and motor components 54, which include a rotor portion and a stator portion, accommodated in the motor housing. The rotor portion, which is included in the motor components 54, is supported by the rotating shaft 51, while the rotating shaft 51 is rotatably supported by an upper bearing 55 held on a central portion of the upper housing portion 52 and a lower bearing 56 held on a central portion of the bottom cover 30. Once the motor portion 50 is driven, the rotating shaft 51 is caused to rotate together with the rotor portion, which is included in the motor components 54, so that the impeller 40, which is joined to the rotating shaft 51, is also caused to rotate. Rotation of each of the rotor blades 42 of the impeller 40 pushes air in the vicinity of the rotor blade 42 radially outward, generating negative pressure near a radially inner portion of the rotor blade 42, so that external air is sucked in through the air inlet 12. The impeller 40 is caused by the motor portion 50 to rotate in, for example, a counterclockwise direction in a plan view. That is, the impeller 40 is arranged above the motor portion 50, is joined to the rotating portion of the motor portion 50, and is arranged to rotate to send a gas from above radially outward.

The body cover portion 2, which is arranged to cover an outer circumference of the motor portion 50, is defined by the upper cover 18 and the lower cover 20. That is, the body cover portion 2 includes the upper and lower covers 18 and 20. In addition, the body cover portion 2, more specifically, the upper cover 18 thereof, is joined to the impeller cover portion 14. The body cover portion 2 is arranged to cover an outer circumferential surface 50*a* of the motor portion 50. A tubular space 60 is defined between an inner circumferential surface 2*a* of the body cover portion 2 and the outer circumferential surface 50*a* of the motor portion 50. That is, the body cover portion 2 defines the tubular space 60 between the motor portion 50 and the body cover portion 2. The outer circumferential surface 50*a* of the motor portion 50 is arranged to extend in a straight line in the vertical direction. Meanwhile, the inner circumferential surface 2*a* of the body cover portion 2 is arranged to curve while extending in the vertical direction such that the inner circumferential surface 2*a* becomes closest to the central axis J at a middle portion thereof, being convex radially inwardly. That is, the radial distance between the inner circumferential surface 2*a* of the body cover portion 2 and the central axis J varies continuously. Thus, the tubular space 60 is arranged to vary the width of a radial gap therein as the tubular space 60 extends from the upper side to the lower side through a middle portion thereof.

The tubular space 60 is a channel for air discharged from the impeller 40. In the present preferred embodiment, the channel for the air is defined only radially outside of the motor portion 50. Therefore, the air discharged from the impeller 40 does not flow radially inside of the outer circumferential surface 50*a* of the motor portion 50.

An upper portion of the tubular space 60 is in communication with a space radially outside of the impeller 40 inside the impeller cover portion 14. Each of the air outlets 22 of the lower cover 20 faces a lower portion of the tubular space 60. An inner circumferential surface of the upper cover 18 is defined as a curved surface whose diameter increases with increasing height, while an inner circumferential surface of the lower cover 20 is substantially cylindrical from an upper portion to a middle portion thereof, but is curved at a lower portion thereof, slightly increasing in diameter with decreasing height. As a result, the radial gap in the tubular space 60 is widest at a top thereof, gradually decreases in width toward a middle portion thereof, and then gradually increases in width from the middle portion toward a bottom thereof. Note that a position at which the radial gap in the tubular space 60 is narrow corresponds to, for example, a boundary between a curved portion and a straight portion of each of a plurality of guide vanes 70, which will be described below.

The structure of the tubular space 60 will now be described more specifically below.

The tubular space 60 includes an upper region 61 and a lower region 63 arranged below the upper region 61. The upper and lower regions 61 and 63 are arranged one above the other in the vertical direction, and the lower region 63 is arranged below the upper region 61. An upper end of the tubular space 60 coincides with an upper end 61*a* of the upper region 61. In addition, a lower end of the tubular space 60 coincides with a lower end 63*a* of the lower region 63.

Here, the upper end of the tubular space 60 means an imaginary surface at an axially upper end of the tubular space 60, and corresponds to an upper opening of the channel. Similarly, the lower end of the tubular space 60 means an imaginary surface at an axially lower end of the tubular space 60, and corresponds to a lower opening of the channel.

In the upper region 61, the radial distance between the outer circumferential surface 50*a* of the motor portion 50 and the inner circumferential surface 2*a* of the body cover portion 2 is arranged to continuously decrease with decreasing height. Meanwhile, in the lower region 63, the radial distance between the outer circumferential surface 50*a* of the motor portion 50 and the inner circumferential surface 2*a* of the body cover portion 2 is arranged to continuously increase with decreasing height.

Because the tubular space 60 includes the upper and lower regions 61 and 63 as described above, the radial gap in the tubular space 60 is narrowest at a boundary portion 62 between the upper and lower regions 61 and 63. Air which has flowed into the tubular space 60 is compressed in the upper region 61 due to an increase in channel resistance, and then flows into the lower region 63. As the air which has flowed into the lower region 63 travels downward, the radial gap gradually increases in width. Accordingly, the air is gradually decompressed, so that the flow becomes gradually gentler, and the air is discharged without a separation, resulting in improved air blowing efficiency. In addition, the tubular space 60 as described above contributes to reducing noise because of the improved air blowing efficiency.

In the present preferred embodiment, the upper and lower regions 61 and 63 are adjacent to each other in the vertical direction. That is, a lower end of the upper region 61 coincides with an upper end of the lower region 63, and defines the boundary portion 62. Note, however, that an intermediate region may alternatively be arranged between the upper and lower regions 61 and 63. In this case, the radial distance between the motor portion 50 and the body cover portion 2 is preferably arranged to be constant in the intermediate region.

The radial distance between the outer circumferential surface 50*a* of the motor portion 50 and the inner circumferential surface 2*a* of the body cover portion 2 is preferably arranged to be greater at the upper end 61*a* of the upper region 61 than at the lower end 63*a* of the lower region 63. That is, the radial gap in the tubular space 60 is preferably arranged to have the greatest width at the upper end 61*a* of the upper region 61. The air discharged from the impeller 40 may include a component directed radially outward, when passing the upper end 61*a* of the upper region 61. Accordingly, the radial distance is arranged to be greatest at the upper end 61*a* of the upper region 61 so that the air discharged can be efficiently guided into the tubular space 60 while the direction of the air being discharged is shifted from a radially outward direction toward a downward direction as the air travels along an inner circumferential surface of the impeller cover portion 14. Meanwhile, an excessively large radial distance between the motor portion 50 and the body cover portion 2 at the lower end 63*a* of the lower region 63 might easily cause turbulence, resulting in reduced air exhaust efficiency. Therefore, the radial distance between the motor portion 50 and the body cover portion 2 is preferably arranged to be greater at the upper end 61*a* than at the lower end 63*a*.

The body cover portion 2 includes the upper and lower covers 18 and 20 divided from each other in the vertical direction. A boundary between the upper and lower covers 18 and 20 coincides with the boundary portion 62 between the upper and lower regions 61 and 63. That is, the body cover portion 2 is divided into upper and lower portions at a position at which the radial distance between the outer circumferential surface 50*a* of the motor portion and the inner circumferential surface 2*a* of the body cover portion 2 is smallest in the tubular space 60. Accordingly, the upper cover 18 gradually increases in inside diameter with increasing height from a lower end thereof. Therefore, the upper cover 18 can be easily molded using a mold. Similarly, the lower cover 20 gradually increases in inside diameter with decreasing height from an upper end thereof, and can be easily molded using a mold. Because the body cover portion 2 is divided into the upper and lower portions at the boundary portion 62 as described above, the body cover portion 2 can be easily produced, resulting in a reduced production cost thereof.

Note that, although the body cover portion 2 includes two members (i.e., the upper cover 18 and the lower cover 20) which are divided in the vertical direction in the present preferred embodiment, the body cover portion 2 may alternatively be defined by a single monolithic member.

Figure 7:
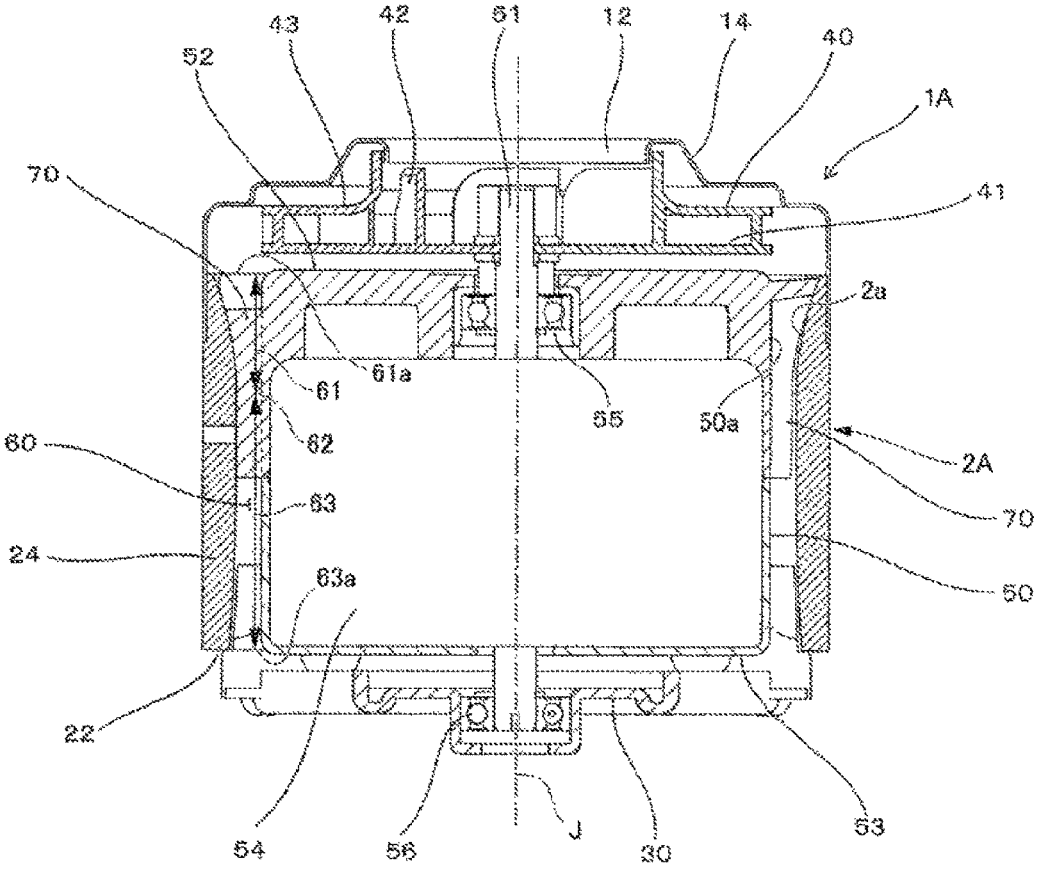
FIG. 7 is a cross-sectional view of a blower apparatus according to a modification of the above preferred embodiment taken along line A-A in FIG. 3, the blower apparatus including a body cover portion defined by a single monolithic member.

FIG. 7 is a cross-sectional view of a blower apparatus 1A according to a modification of the above-described preferred embodiment. The blower apparatus 1A includes a body cover portion 2A defined by a single monolithic member. The body cover portion 2A is defined by a single member which continuously extends in the vertical direction in an inner circumferential surface 2*a*, which defines a tubular space 60. Therefore, the inner circumferential surface 2*a* is a single continuous surface. Accordingly, a joint between members is not exposed in a channel for an air flow passing through the tubular space 60, and the likelihood of a separation of air is reduced, resulting in improved air blowing efficiency. Note that the body cover portion 2A defined by a single monolithic member is molded using a pair of molds which are separated from each other in the vertical direction at a parting line extending along a boundary portion 62.

The plurality of guide vanes 70 are arranged at regular intervals in the circumferential direction in the tubular space 60. This allows the air flow to be efficiently guided along a surface of each guide vane 70 without a separation of the air flow. The plurality of guide vanes 70 are integrally molded with the upper housing portion 52, and each guide vane 70 includes a curved portion (a guide vane upper portion) 71 arranged in an upper portion thereof, and a straight portion (a guide vane lower portion) 72 continuous with the curved portion 71 and arranged to extend axially downward therefrom. That is, each of the plurality of guide vanes 70 includes the guide vane upper portion and the guide vane lower portion. The guide vane upper portion is inclined to a greater degree with respect to the axial direction than the straight portion 72. The curved portion 71 of each guide vane 70 is curved in a direction opposite to a rotation direction of the impeller 40 with increasing height. That is, rotation of the impeller 40 causes an air current whirling in the same direction as the rotation direction of the impeller 40, and the curved shape of the curved portion 71 is defined so that the above air current can be smoothly taken in and guided into a downward flow, and the air channel is defined so as to guide the whirling air current sent from the impeller 40 downward.

Figure 5:
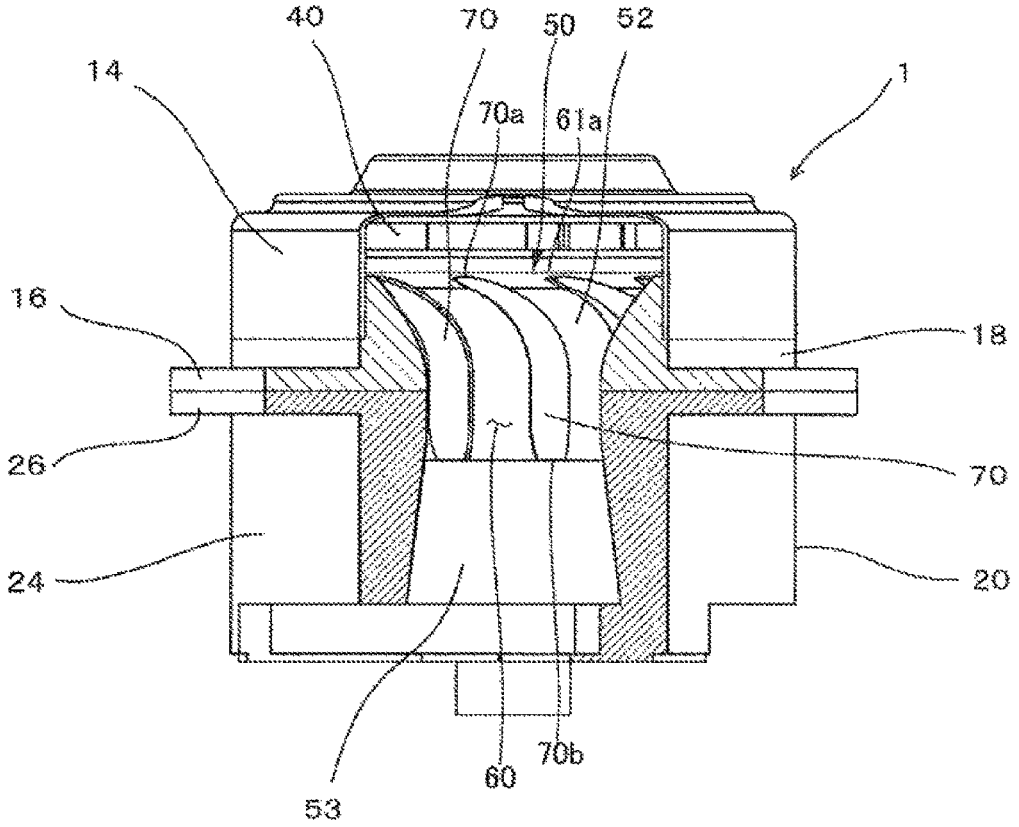
FIG. 5 is a cross-sectional view of the blower apparatus taken along line B-B in FIG. 3.
Figure 6:
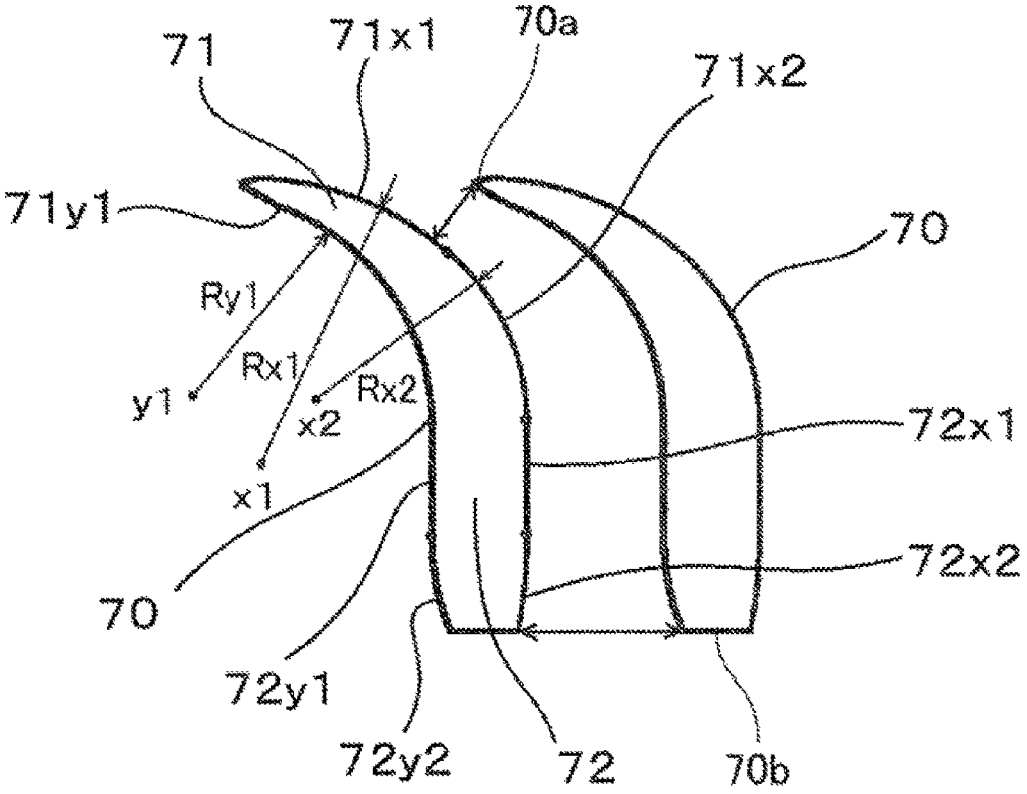
FIG. 6 is a diagram for explaining guide vanes illustrated in FIG. 5 according to a preferred embodiment of the present invention.

FIG. 5 illustrates the blower apparatus 1 when the impeller cover portion 14 and the body cover portion 2 are cut along line B-B in FIG. 3, and FIG. 6 illustrates two of the guide vanes 70 illustrated in FIG. 5 in an enlarged form. As illustrated in FIG. 6, two curved surfaces 71*x*1 and 71*x*2 which have different radii of curvature are continuously defined on the downstream side of the curved portion 71 of each guide vane 70 with respect to the rotation direction of the impeller 40. A radius of curvature Rx1 of the curved surface 71*x*1 on the upper side is greater than a radius of curvature Rx2 of the curved surface 71*x*2 on the lower side (Rx1>Rx2). In addition, on the upstream side of the curved portion 71 of each guide vane 70 with respect to the rotation direction of the impeller 40, a curved surface 71*y*1 having a radius of curvature Ry1 smaller than that of the curved surface 71*x*1 is defined (Rx1>Ry1). A center y1 of the curved surface 71*y*1 is located upstream of a center x1 of the curved surface 71*x*1 and a center x2 of the curved surface 71*x*2 with respect to the rotation direction of the impeller 40.

On the downstream side of the straight portion 72 of each guide vane 70 with respect to the rotation direction of the impeller 40 are defined a flat surface 72*x*1 continuous with the curved surface 71*x*2, and a slanting surface 72*x*2 arranged below the flat surface 72*x*1 and arranged to slant toward the upstream side with respect to the rotation direction of the impeller 40 with decreasing height. Meanwhile, on the upstream side of the straight portion 72 with respect to the rotation direction are defined a flat surface 72*y*1 continuous with the curved surface 71*y*1, and a slanting surface 72*y*2 arranged below the flat surface 72*y*1 and arranged to slant toward the downstream side with respect to the rotation direction with decreasing height.

Each of the plurality of guide vanes 70 is arranged to axially overlap in part with an adjacent one of the guide vanes 70. Specifically, referring to FIG. 5, a tip portion of the curved portion 71 of each guide vane 70 is arranged to axially overlap with both the curved portion 71 and the straight portion 72 of an adjacent one of the guide vanes 70 which is arranged upstream thereof with respect to the rotation direction of the impeller 40. The above structure allows the guide vanes 70 to more efficiently take in air sent from the impeller 40 and guide the air into the downward flow.

A lower end 70*b* of each guide vane 70 is arranged downstream of an upper end 70*a* of the guide vane 70 with respect to the rotation direction of the impeller 40. The guide vanes 70 are thus able to guide a wind flowing along the rotation direction of the impeller 40 smoothly axially downward, and are able to improve the air blowing efficiency. Note that the circumferential positions of the upper end 70*a* and the lower end 70*b* may be compared with each other at a radially outer end of each guide vane 70 to determine which of the upper end 70*a* and the lower end 70*b* of the guide vane 70 lies downstream of the other with respect to the rotation direction. Here, it is preferable that the lower end 70*b* is arranged downstream of the upper end 70*a* with respect to the rotation direction of the impeller 40. For example, also in a case where the guide vane 70 is inclined with respect to the radial direction when viewed from axially above, and in a case where an upper surface of the guide vane 70 is inclined with respect to a direction perpendicular to the axial direction when viewed in the radial direction, the circumferential positions of the upper end 70*a* and the lower end 70*b* may be compared with each other at the radially outer end of the guide vane 70.

As illustrated in FIG. 5, the axial position of the upper end 70*a* of each guide vane 70 coincides with the axial position of an upper end of the motor portion 50. The upper end of the motor portion 50 coincides with the upper end of the tubular space 60 (i.e., the upper end 61*a* of the upper region 61). As described above, the upper end 61*a* of the upper region 61 is a position at which the radial gap in the tubular space 60 is arranged to have the greatest width. Arranging the upper end 70*a* of each guide vane 70 at the position at which the radial gap in the tubular space 60 has the greatest width contributes to reducing the likelihood that turbulence will occur in the air current, and improving the air blowing efficiency.

An intervane space between every adjacent ones of the plurality of guide vanes 70, which are arranged at regular intervals in the circumferential direction in the tubular space 60, is arranged to be narrowest at a tip of the curved portion 71 of the guide vane 70 and widest at a lower end of the straight portion 72 of the guide vane 70 when measured in a direction perpendicular to a direction in which the gas flows through the air channel between the adjacent guide vanes 70.

Once the motor portion 50 is driven in the blower apparatus 1 having the above-described structure, the impeller 40 is caused to rotate to take in external air through the air inlet 12 of the impeller cover portion 14 and discharge the air radially outward as a swirl flow, so that the air is guided to an inner surface of the cylindrical outer circumferential portion of the impeller cover portion 14. Further, the air current discharged from the impeller 40 is guided into the tubular space 60 to pass through the intervane space between the adjacent guide vanes 70, so that the swirl flow is guided into an axial flow.

At this time, each guide vane 70 is able to effectively take the swirl flow from the impeller 40 into the interspace between the guide vanes 70 through the curved portion 71 arranged in the upper portion thereof. Further, the thickness of the curved portion 71 is arranged to vary along the direction in which the air flows, that is, the curved portion 71 is arranged to have a sophisticated shape with the two curved surfaces 71*x*1 and 71*x*2, which have different radii of curvature, being defined on the downstream side of the guide vane 70 with respect to the rotation direction, and the one curved surface 71*y*1 being defined on the upstream side of the curved portion 71 with respect to the rotation direction, and this contributes to reducing the likelihood of a separation of the air flow, allowing the air flow to be efficiently guided along the surface of the guide vane 70. In particular, when the radii of curvature Rx1 and Rx2 of, respectively, the two curved surfaces 71*x*1 and 71*x*2 on the downstream side of the curved portion 71 with respect to the rotation direction meet the relationship Rx1>Rx2, and the radius of curvature Ry1 of the curved surface 71*y*1 on the upstream side of the curved portion 71 with respect to the rotation direction meets the relationship Rx1>Ry1, the air flow in the tubular space 60 is improved to achieve a significant improvement in efficiency.

A boundary between the curved portion 71 and the straight portion 72 is arranged in the vicinity of the position at which the radial distance between the outer circumferential surface 50*a* of the motor portion 50 and the inner circumferential surface 2*a* of the body cover portion 2 is smallest in the tubular space 60 (i.e., the boundary portion 62 in the present preferred embodiment). Because the radial gap in the tubular space 60 is narrowest in the vicinity of the boundary between the curved portion 71 and the straight portion 72 of each guide vane 70, air which has flowed into the tubular space 60 is compressed in the vicinity of the boundary between the curved portion 71 and the straight portion 72 due to an increase in channel resistance, and the air is thereafter decompressed to form a gentle air flow due to a gradual increase in the width of the radial gap as the air travels downward along the straight portion 72, completing discharge of the air without occurrence of a separation of the air. In particular, the above effect is promoted by a gradual increase in the width of the intervane space between the adjacent guide vanes 70 at a lower portion of the straight portion 72.

While preferred embodiments of the present invention have been described above, it will be understood that the present invention is not limited to the above-described preferred embodiments, and that a variety of modifications are possible without departing from the scope of the present invention as claimed below.

In the above-described preferred embodiment, each of the plurality of guide vanes 70 arranged in the tubular space 60 is arranged to axially overlap in part with an adjacent one of the guide vanes 70. Note, however, that each of the plurality of guide vanes 70 may not necessarily be arranged to axially overlap with an adjacent one of the guide vanes 70. When the guide vanes 70 do not axially overlap with one another, the structure of a resin molding mold for the guide vanes 70 can be simplified. Meanwhile, in the case where the guide vanes 70 are arranged to axially overlap in part with one another, it may be so arranged that alternate ones of the guide vanes 70 are integrally defined with the upper housing portion 52 while the other alternate ones of the guide vanes 70 are integrally defined with the upper cover 18.

Further, although, in the above-described preferred embodiment, the straight portion 72 of each of the plurality of guide vanes 70 arranged in the tubular space 60 is arranged to extend axially downward, this is not essential to the present invention. The straight portion 72 may be arranged to extend downward and be angled with respect to the axial direction toward the direction in which the curved portion 71 is curved. When each guide vane 70 is shaped in such a manner, an effect similar to the effect of the above-described preferred embodiment can be obtained even if the length of the curved portion 71 is reduced, and therefore, the length of each guide vane 70 can be reduced to achieve a reduction in the size of the blower apparatus 1 as a whole.

Although, in the above-described preferred embodiment, the impeller 40 caused by the motor portion 50 to rotate is a centrifugal impeller, this is not essential to the present invention. A mixed flow impeller may alternatively be used. In this case, the mixed flow impeller is joined to the rotating portion of the motor portion, and is caused by the motor portion to rotate to suck a gas from above and send the gas radially outward while guiding the gas along slanting surfaces of the mixed flow impeller.

Next, a blower apparatus 101 according to a modification of the above-described preferred embodiment will now be described below with reference to FIG. 8. Note that members or portions that have their equivalents in the above-described preferred embodiment are denoted by the same reference numerals as those of their equivalents in the above-described preferred embodiment, and descriptions of those members or portions are omitted.

Figure 8:
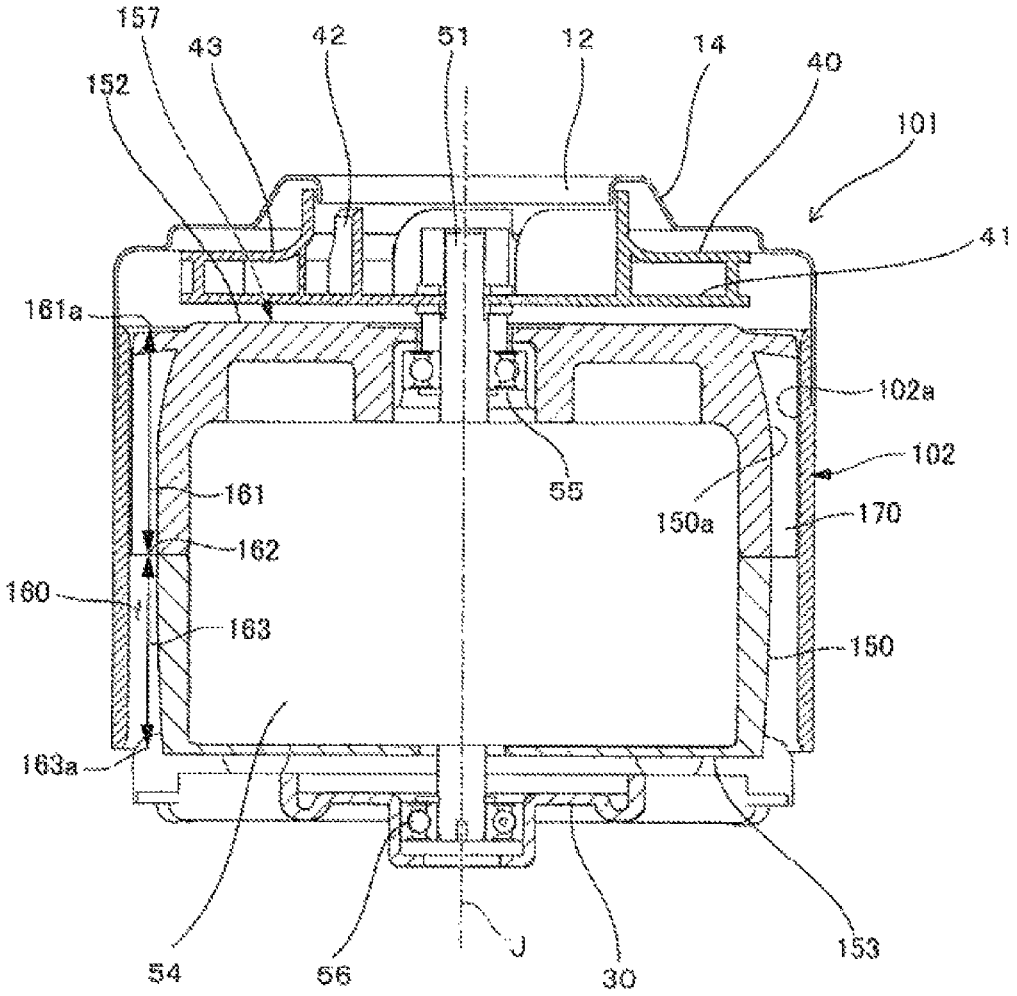
FIG. 8 is a cross-sectional view of a blower apparatus according to a first modification of the above preferred embodiment of the present invention.

FIG. 8 is a cross-sectional view of the blower apparatus 101, and corresponds to FIG. 4 of the above-described preferred embodiment. The blower apparatus 101 is different from the blower apparatus 1 according to the above-described preferred embodiment in the structures of a body cover portion 102 and a motor housing 157 (an upper housing portion 152 and a lower housing portion 153) of a motor portion 150.

The body cover portion 102 is arranged to cover an outer circumferential surface 150*a* of the motor portion 150. The body cover portion 102 is joined to an impeller cover portion 14 at an upper end thereof. An inner circumferential surface 102*a* of the body cover portion 102 is arranged to extend in a straight line in the vertical direction.

The motor portion 150 includes the motor housing 157, which includes the upper and lower housing portions 152 and 153, and motor components 54 accommodated in the motor housing 157. That is, the motor portion 150 includes a housing portion including an outer circumferential surface defining a tubular space 160. The outer circumferential surface 150*a* of the motor portion 150 includes outer circumferential surfaces of the upper and lower housing portions 152 and 153 continuous with each other. The outer circumferential surface 150*a* of the motor portion 150 is arranged to curve while extending in the vertical direction such that the outer circumferential surface 150*a* becomes most distant from a central axis J at a middle portion thereof, being convex radially outwardly. That is, the radial distance between the outer circumferential surface of the housing portion and the central axis J varies continuously along the tubular space 160. On the outer circumferential surface 150*a* of the motor portion 150, a plurality of guide vanes 170 are arranged at regular intervals in the circumferential direction.

The tubular space 160 is defined between the inner circumferential surface 102*a* of the body cover portion 102 and the outer circumferential surface 150*a* of the motor portion 150. That is, the body cover portion 102 defines the tubular space 160 between the motor portion 150 and the body cover portion 102. The tubular space 160 includes an upper region 161 and a lower region 163 arranged one above the other in the vertical direction. In the upper region 161, the radial distance between the outer circumferential surface 150*a* of the motor portion 150 and the inner circumferential surface 102*a* of the body cover portion 102 (i.e., the width of a radial gap in the tubular space 160) is arranged to continuously decrease with decreasing height. Meanwhile, in the lower region 163, the radial distance between the outer circumferential surface 150*a* of the motor portion 150 and the inner circumferential surface 102*a* of the body cover portion 102 (i.e., the width of the radial gap in the tubular space 160) is arranged to continuously increase with decreasing height. In addition, the radial distance between the outer circumferential surface 150*a* of the motor portion 150 and the inner circumferential surface 102*a* of the body cover portion 102 is arranged to be greater at an upper end 161*a* of the upper region 161 than at a lower end 163*a* of the lower region 163.

Due to the inclusion of the tubular space 160 including the upper and lower regions 161 and 163, which are similar to those of the blower apparatus 1 according to the above-described preferred embodiment, the blower apparatus 101 according to the present modification is able to achieve beneficial effects similar to those of the blower apparatus 1. That is, beneficial effects of an improvement in the air blowing efficiency and a reduction in noise can be achieved.

The motor housing 157 includes the upper and lower housing portions 152 and 153 divided from each other in the vertical direction. A boundary between the upper and lower housing portions 152 and 153 coincides with a boundary portion 162 between the upper and lower regions 161 and 163. That is, the housing portion is divided into upper and lower portions at a position at which the radial distance between the outer circumferential surface 150*a* of the motor portion 150 and the inner circumferential surface 102*a* of the body cover portion 102 is smallest in the tubular space 160. The motor housing 157 is divided into upper and lower portions at the position at which the radial distance between the outer circumferential surface 150*a* of the motor portion 150 and the inner circumferential surface 102*a* of the body cover portion 102 is smallest in the tubular space 160 (i.e., at the boundary portion 162 in the present modification). Accordingly, the upper housing portion 152 gradually decreases in outside diameter with increasing height from a lower end thereof. Therefore, the upper housing portion 152 can be easily molded using a mold. Similarly, the lower housing portion 153 gradually decreases in outside diameter with decreasing height from an upper end thereof, and can be easily molded using a mold. Because the motor housing 157 is divided into the upper and lower portions at the boundary portion 162 as described above, the motor housing 157 can be easily produced, resulting in a reduced production cost thereof.

Figure 9:
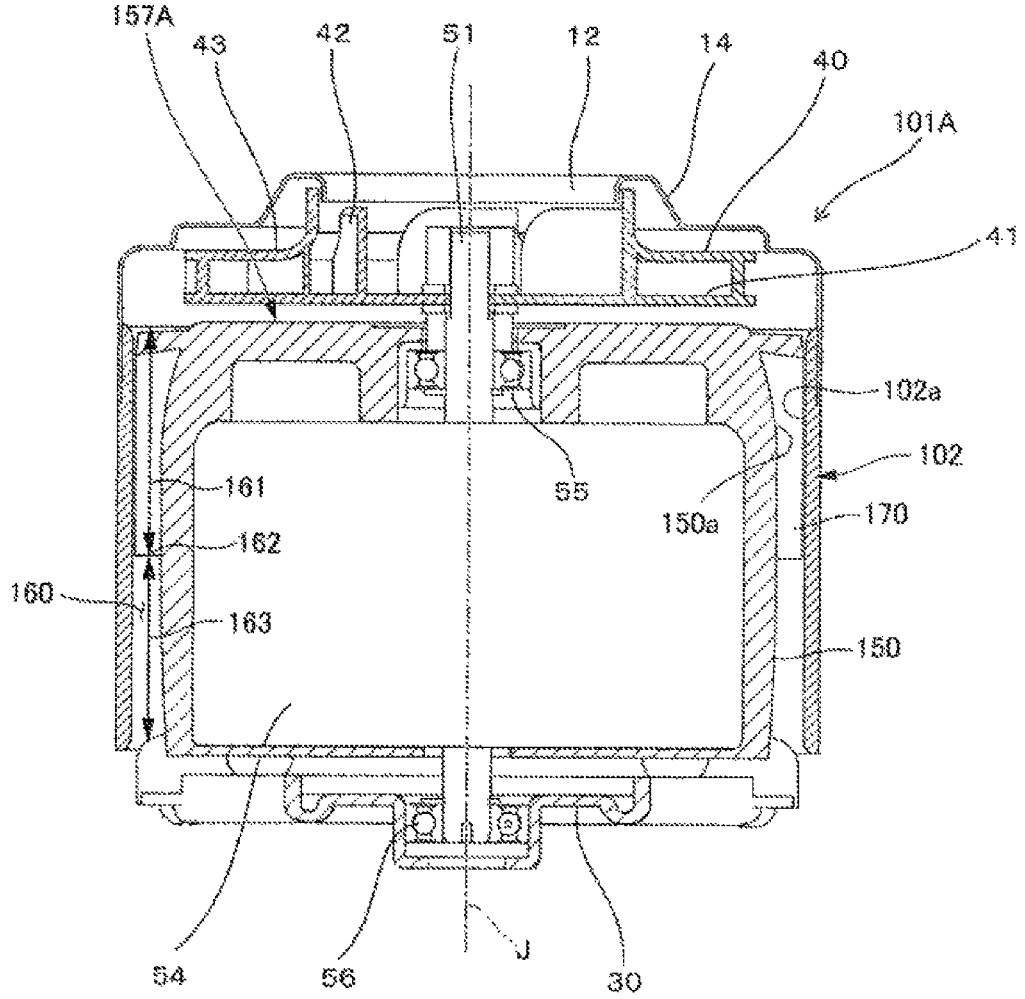
FIG. 9 is a cross-sectional view of a blower apparatus according to a modification of the above preferred embodiment of the present invention, the blower apparatus including a motor housing defined by a single monolithic member.

Note that the motor housing 157 may alternatively be defined by a single monolithic member. FIG. 9 illustrates a blower apparatus 101A according to a modification of the above-described preferred embodiment. The blower apparatus 101A includes a motor housing 157A defined by a single monolithic member. A housing portion is defined by a single member which continuously extends in the vertical direction in an outer circumferential surface 150*a*, which defines a tubular space 160, and the outer circumferential surface 150*a* defines a single continuous surface. Accordingly, a joint between members is not exposed in a channel for an air flow passing through the tubular space 160, and the likelihood of a separation of air is reduced, resulting in improved air blowing efficiency. In the case where the housing portion is defined by a single member, a parting line is defined at a position at which the radial distance between the outer circumferential surface 150*a* of a motor portion 150 and an inner circumferential surface 102*a* of a body cover portion 102 is smallest. The motor housing 157A is preferably molded integrally with a stator including a conducting wire wound into a coil buried in the motor housing 157A. The stator can thus be securely held thereby.

Figure 10:
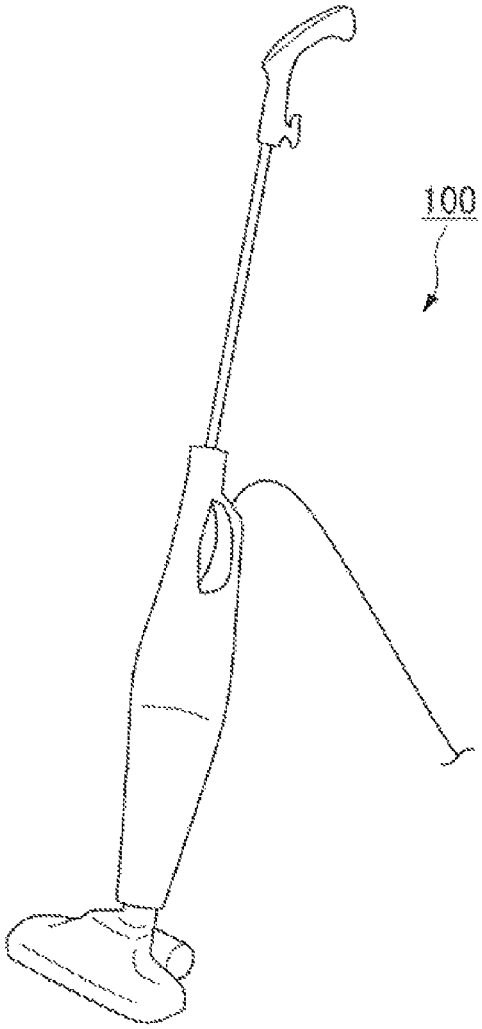
FIG. 10 is a perspective view of a vacuum cleaner according to a preferred embodiment of the present invention.

FIG. 10 is a perspective view of a vacuum cleaner 100 according to a preferred embodiment of the present invention. The vacuum cleaner 100 includes the above-described blower apparatus 1. The vacuum cleaner 100 is thus able to achieve reduced noise while maintaining a static pressure inside the blower apparatus installed therein. Accordingly, a reduction in noise of the vacuum cleaner 100 can also be achieved.

Although the blower apparatus according to the above-described preferred embodiment of the present invention is used in a vacuum cleaner which utilizes air sucked by the blower apparatus, this is not essential to the present invention. A blower apparatus according to a preferred embodiment of the present invention may be used in, for example, a hair drier.

Blower apparatuses according to preferred embodiments of the present invention are suitable for use in, for example, electric vacuum cleaners, hair driers, and the like.

Features of the above-described preferred embodiments and the modifications thereof may be combined appropriately as long as no conflict arises.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

The invention claimed is:

1. A blower apparatus comprising:

a motor portion having a central axis extending in a vertical direction;

an impeller arranged above the motor portion, joined to a rotating portion of the motor portion, and arranged to rotate to send a gas from above radially outward;

an impeller cover portion including an inner surface arranged to cover an outer circumference of the impeller and an upper side of an outer edge portion of the impeller, and further including an air inlet defined in a center thereof; and a body cover portion joined to the impeller cover portion, arranged to cover an outer circumferential surface of the motor portion, and arranged to define a tubular space between the motor portion and the body cover portion; wherein the tubular space includes an upper region and a lower region arranged below the upper region;

a radial distance between the outer circumferential surface of the motor portion and an inner circumferential surface of the body cover portion is arranged to continuously decrease with decreasing height in the upper region, and continuously increase with decreasing height in the lower region; and the radial distance is arranged to be greater at an upper end of the upper region than at a lower end of the lower region.

2. The blower apparatus according to claim 1, wherein a radial distance between the inner circumferential surface of the body cover portion and the central axis is arranged to continuously vary along the tubular space.

3. The blower apparatus according to claim 1, wherein the body cover portion is divided into upper and lower portions at a position at which the radial distance between the outer circumferential surface of the motor portion and the inner circumferential surface of the body cover portion is smallest in the tubular space.

4. The blower apparatus according to claim 1, wherein the body cover portion is defined by a single member which continuously extends in the vertical direction in an inner circumferential surface defining the tubular space.

5. The blower apparatus according to claim 1, wherein the motor portion includes a housing portion including an outer circumferential surface defining the tubular space; and a radial distance between the outer circumferential surface of the housing portion and the central axis is arranged to continuously vary along the tubular space.

6. The blower apparatus according to claim 5, wherein the housing portion is divided into upper and lower portions at a position at which the radial distance between the outer circumferential surface of the motor portion and the inner circumferential surface of the body cover portion is smallest in the tubular space.

7. The blower apparatus according to claim 5, wherein the housing portion is defined by a single member which continuously extends in the vertical direction in an outer circumferential surface defining the tubular space.

8. The blower apparatus according to claim 1, further comprising a plurality of guide vanes arranged at regular intervals in a circumferential direction in the tubular space.

9. The blower apparatus according to claim 8, wherein each of the plurality of guide vanes includes a guide vane upper portion and a guide vane lower portion;

the guide vane upper portion is inclined to a greater degree with respect to an axial direction than the guide vane lower portion; and a lower end of the guide vane is arranged downstream of an upper end of the guide vane with respect to a rotation direction of the impeller.

10. The blower apparatus according to claim 8, wherein an axial position of an upper end of each guide vane and an axial position of an upper end of the motor portion are arranged to coincide with each other.

11. A vacuum cleaner comprising the blower apparatus of claim 1.

* * * * *